United States Patent [19]

Morikawa et al.

[11] 4,389,548

[45] Jun. 21, 1983

[54] ACOUSTIC TRANSDUCER

[75] Inventors: Eiji Morikawa, Neyagawa; Toshifumi Morita, Osaka; Masayuki Hirate, Takatsuki, all of Japan

[73] Assignee: Sanyo Electric Co., Ltd., Osaka, Japan

[21] Appl. No.: 248,330

[22] Filed: Mar. 27, 1981

[30] Foreign Application Priority Data

Sep. 11, 1980 [JP] Japan ..... 55-130588[U]

[51] Int. Cl.[3] ..... H04R 15/00

[52] U.S. Cl. ..... 179/110 A

[58] Field of Search ..... 179/110 A, 180, 179; 181/157; 336/20; 310/8.2, 9.1, 9.4, 9.5, 331, 332, 363, 364

[56] References Cited

U.S. PATENT DOCUMENTS 3,548,116 12/1970 Schafft ..... 179/110 A 4,283,605 8/1981 Nakajima ..... 179/110 A

*Primary Examiner*—Benjamin R. Fuller

*Attorney, Agent, or Firm*—Armstrong, Nikaido, Marmelstein & Kubovcik

[57] ABSTRACT

In an acoustic transducer comprising a piezoelectric element for driving a speaker diaphragm, there is provided a cushioning member between a frame body and the piezoelectric element wherein said cushioning member is preliminarily adhered onto the top face of a bottom portion of the frame body by means of an adhering layer formed on the bottom face of the cushioning member with the piezoelectric element preliminarily adhered on the top face of the cushioning member by means of an adhering layer formed on the top face of the cushioning member so as to facilitate to mount the piezoelectric element and a speaker diaphragm on the frame body.

4 Claims, 5 Drawing Figures

ACOUSTIC TRANSDUCER

The present invention relates to an acoustic transducer having piezoelectric elements for conversions between electrical and mechanical stimuli.

An acoustic transducer of the above type, for example, a piezoelectric speaker is suitable for a tweeter due to the following charateristics such as low power consumption compared with the dynamic speaker, high frequency responsibility, light in weight and the absence of magnetic field effect.

One example of a piezoelectric speaker is well known by U.S. Pat. No. 3,548,116.

Figure 1:
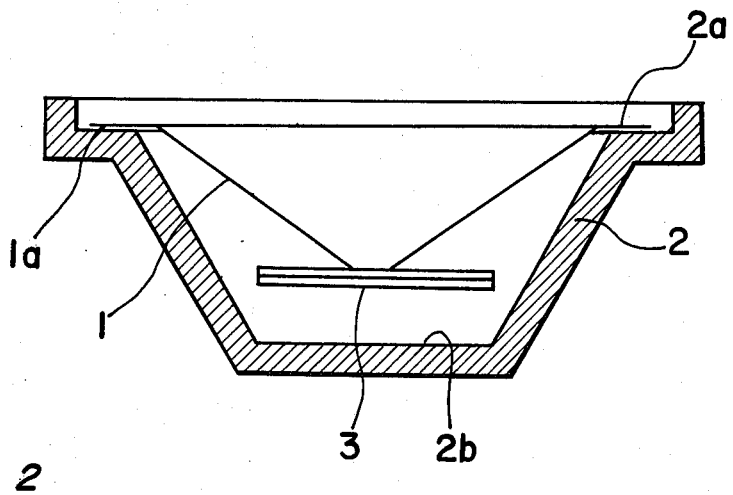
Fig. 1 (PRIOR ART)

FIG. 1 shows one example of a conventional piezoelectric speaker, known by the U.S. Patent mentioned above wherein a speaker diaphragm 1 having a conical shape in cross section is secured to a frame body 2 with a peripheral edge 1*a* of the diaphragm 1 affixed to a flange 2*a* of the frame body 2. A piezoelectric element 3 is secured to the central portion of the speaker diaphragm 1.

In the conventional piezoelectric speaker of FIG. 1, the piezoelectric element 3 is supported only by hanging from the apex of the speaker diaphragm 1 above the bottom portion 2*b* of the frame body 2.

Impressing an alternating voltage across the piezoelectric element 3 through a pair of flexible lead wires (not shown) causes the piezoelectric element 3 to oscillate. As the oscillation of the piezoelectric element 3 is transferred to the speaker diaphragm 1 through only the connecting portion between the apex of the diaphragm 1 and the piezoelectric element 3, the speaker arrangement of this type operate with high efficiency. Furthermore, it has such an advantage that the arrangement can be constructed with a few number of parts with a simple construction.

However, the conventional piezoelectric speaker as mentioned above has the following disadvantage during assembly. Initially the speaker diaphragm 1 is joined to the piezoelectric element 3 with the apex of the diaphragm 1 adhered at the center of the one surface of the element by using suitable support and positioning jigs or fixtures. After that process, the peripheral edge 1*a* of the speaker diaphragm 1 is secured to the flange 2*a* of the frame 2. As understood from the foregoing, the piezoelectric element 3 must be fixed to the speaker diaphragm which is supported by the fixture under unstable manner, the fixtures must be subjected to support the diaphragm 1 until the adhesives between the diaphragm and the wafer has curred. Thus, in manufacturing the conventional piezoelectric speaker, it takes a long time to complete the assembling of the speaker and since the partially prepared diaphragm must be associated with fixtures, automatic production system is not available.

Accordingly, an essential object of the present invention is to eliminate the drawbacks as mentioned above inherent in the prior art and to provide an acoustic transducer which is capable of being easily and quickly manufactured without complex fixtures.

The present invention will be fully described in conjunction with a preferred embodiment of a speaker with reference to the attached drawings.

Figure 2:
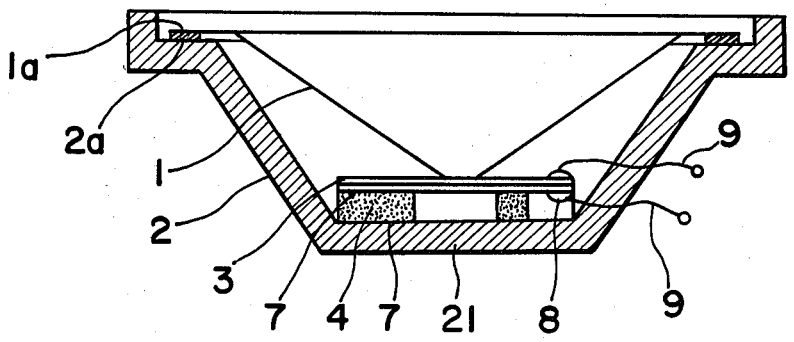
Figure 3:
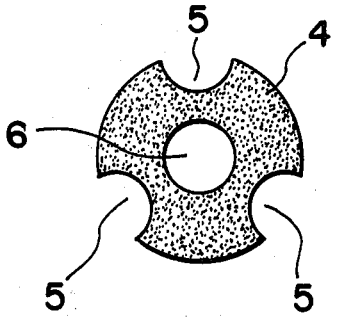
Figure 4:
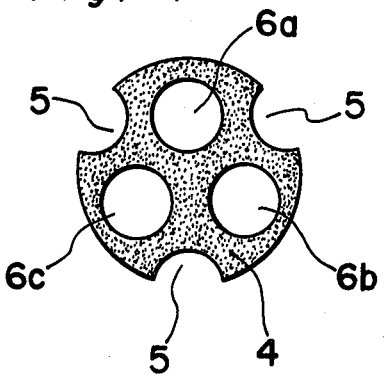
Figure 5:
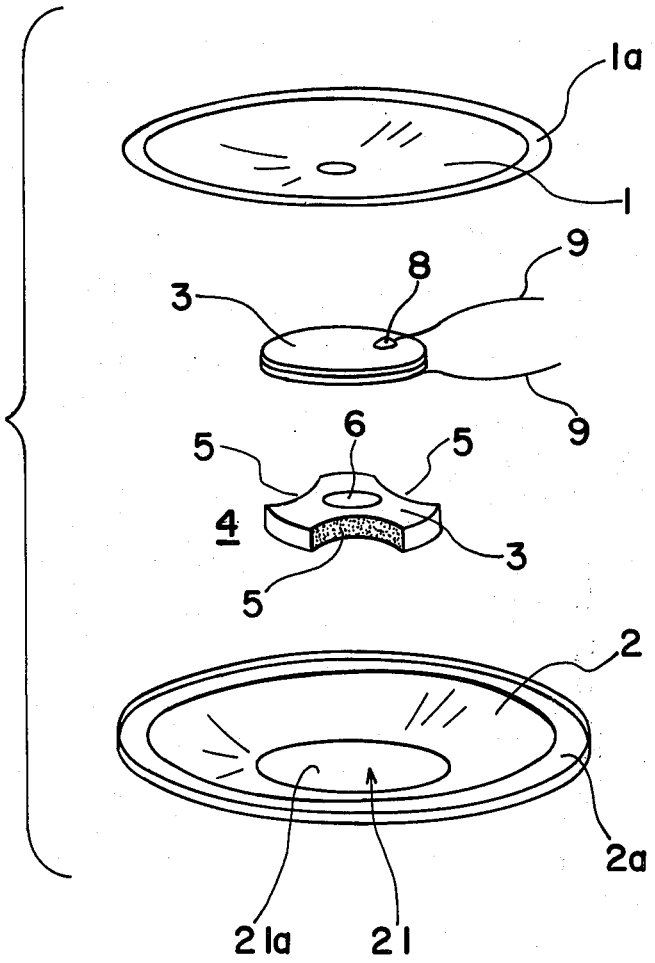

FIG. 1 is a cross sectional view showing a conventional piezoelectric speaker, FIG. 2 is a cross sectional view showing a preferred embodiment of a piezoelectric speaker according to the present invention, FIG. 3 is a plan view showing one example of a cushioning member employed in the speaker shown in FIG. 2, FIG. 4 is a plan view showing another example of a cushioning member employed in the speaker shown in FIG. 2 and FIG. 5 is an exploded view of the speaker shown in FIG. 2.

Referring to FIG. 2, the respective reference numerals 1, 2 and 3 are the speaker diaphragm, frame body and the piezoelectric element generally similar to those as shown in the elements shown in FIG. 1.

The frame body 2 has a bottom portion 21 having generally circular shape in plan view with a given diameter.

The piezoelectric element 3 is formed in a known manner by one or more piezoelectric wafers made of for example lead titanate or lead zirconate attached to either one surface or both surfaces of a metal plate such as a brass plate.

A cushioning member 4 is provided between the bottom portion 21 of the frame body 2 and the piezoelectric element 3 to support the latter. The cushioning member is made of a soft material such as expanded polyurethane foam or moltplane, with a generally circular shape in plan view having a diameter substantially equal to that of the bottom portion 21 of the frame body 2.

Around the peripheral portion of the cushioning member as shown in FIG. 3 there are defined three arcuated cut portions 5 destributed symmetrically with reference to the center of the cushioning member 4 and a circular hole 6 coaxial with the central axis of the cushioning member 4. The top and bottom surfaces of the cushioning member 4 are each coated with suitable adhesive layers 7 so that the cushioning member 4 is preliminarily adhered to the bottom portion of the frame body 2 as hereinafter described. For example, said adhesive layer may be formed by means of a double sided adhesive tape adhered on each surface of the cushioning member 4.

FIG. 4 shows another example of the cushioning member 4 wherein three through holes 6*a*, 6*b* and 6*c* are defined symmetrically relative to the center of the cushioning member 4.

The manufacturing process of the speaker as mentioned above is hereinafter described.

Initially, the cushioning member 4 with the each surface coated by an adhesive layer 7 is placed on the upper surface 21*a* of the bottom portion 21 of the frame body 2 to which it adheres. Since the shape and size of the cushioning member 4 is defined similar to that of bottom portion 21 of the frame body 2, the cushioning member 4 can be placed by automatic equipment in the central portion of the upper surface 21*a* of the bottom portion 21 i.e., in a position where the center of the cushioning member 4 generally coincides with the center of the bottom portion 21. It is one advantage of the invention that the cushioning member 4 can be preliminarily fixed on the bottom portion 21 only by placing the cushioning member 4 thereon due to the adhesive layer 7, simplifying the manufacturing process.

Subsequently, the piezoelectric element 3 having a pair of lead wires 9 is placed on the upper surface of the cushioning member 4 already adhering to the bottom portion of the frame body 2 adjusting the position of the piezoelectric element 4 so as to align the peripheral edge of the element 3 with the peripheral edges of the cushioning member 4. As there are provided cut portions 5 and the through hole 6 in the cushioning member 4 symmetrical with the center thereof, the piezoelectric element 3 is easily aligned relative to the center of the cushioning member 4 by judging the shape of each of the cut portions 5 and/or the through hole 6 appearing viewed from the top side. Thus the piezoelectric element 3 can be preliminarily adhered to the cushioning member 4 in position.

Preferably when the piezoelectric element 3 is placed in position, the soldered projection 8 on the lower surface of the piezoelectric element 3 where a lead wire 9 is connected with the electrode (not shown) of the element 3 is positioned in the space defined by one of the cut portions 5 or the through hole 6.

Subsequently, the apex of the speaker diaphragm 1 is adhered at the center of the top face of the piezoelectric element 3 by means of adhesives simultaneously with the peripheral edge 1*a* of the speaker diaphragm 1 adhered on the top face of the flange 2*a* of the frame body 2, thus completing the piezoelectric speaker.

According to the present invention, since the piezoelectric element is preleminarily adhered on the cushioning member adhered on the frame body, then the conical speaker diaphragm is adhered on the piezoelectric element, these elements can be fixed each other without fixtures or jigs, so that the speaker can be easily manufactured by automation system.

In addition, since there are provided suitable number of holes and/or cut portions in the cushioning member, a total contacting area between the cushioning member and the piezoelectric element are effectively decreased, whereby the loss of vibration energy occurring from the piezoelectric element due to the contact between the piezoelectric element and the cushioning member can be decreased so that the acoustic energy can be transduced from the electric signal with high efficiency.

Furthermore, according to the specific features of the present invention, the cushioning member has such a size that generally equal to or slightly smaller than the area of the bottom face of the frame body to which the cushioning member is positioned, so that the cushioning member can easily adjusted in position with high accuracy.

Furthermore, since one or more holes and/or cut portions are defined in the cushioning member symmetrically with reference to the center of the cushioning member, it facilitates to position the piezoelectric element on the cushioning member in a desired position with high accuracy.

Furthermore, the connection of the lead wire to the piezoelectric element is so disposed as to correspond the cut portions or the through hole, the connecting portion can be prevented from abutting onto the cushioning member to prevent occurrence of undesired acoustic effects. In addition the insulating cover of the lead wire is not separated.

Although the present invention is described by a speaker, the present invention can be applied to any transducer for conversions between electric and mechanical stimuli.

What is claimed is:

1. An acoustic transducer including a piezoelectric element comprising:

a frame body having a space defined by a flat bottom portion of a predetermined area, a side frame connected with the peripheral edge of the bottom portion and a flange formed integrally with the free end of the side frame, a cushioning means having a bottom face and a top face, said bottom and top faces having an adhesive layer formed thereon prior to the assembly of said acoustic transducer, the bottom face thereof being fitted on the upper surface of the bottom portion, a piezoelectric element mounted on the top face of the cushioning means, and a speaker diaphragm with an apex having an axially movable portion formed in a conical form in cross-section along the axis, the apex portion of the diaphragm being attached to the central portion of the upper face of the piezoelectric element, wherein said cushioning means has an outer diameter equal to or less than the diameter of the flat bottom face of the frame body and wherein said cushioning means is adhered onto the top face of the bottom portion of the frame body by means of the adhering layer formed on the bottom face thereof and said cushioning means is adhered to the piezoelectric element by means of the adhering layer formed on the top face thereof such that the apex portion of the speaker diaphragm is secured to the central portion of the piezoelectric element, said piezoelectric element having been previously secured to said cushioning means, with the peripheral edge of the speaker diaphragm being secured to the flange of the frame body, said cushioning means further includes at least one cut portion and/or through hole thereby decreasing the energy absorbed in the cushioning means from the piezoelectric element.

2. The acoustic transducer according to claim 1, wherein the cut portions and/or through holes are positioned symmetrically relative to the center of said cushioning means.

3. The acoustic transducer according to claim 1 or claim 2, wherein lead wires for carrying electric power to said piezoelectric element are connected to both sides thereof and said lead wire for the bottom face of the piezoelectric element is connected at a position corresponding to the cut portion or through hole of said cushioning means.

4. The acoustic transducer according to claim 1, wherein the outer diameter of said piezoelectric element is equal to or less than the outer diameter of said cushioning means.

* * * * *